US007751756B2

(12) United States Patent
Bitoh et al.

(10) Patent No.: US 7,751,756 B2
(45) Date of Patent: Jul. 6, 2010

(54) COLOR IMAGE FORMING METHOD AND COLOR IMAGE FORMING APPARATUS

(75) Inventors: Takahiro Bitoh, Nara (JP); Hitoshi Nagahama, Uji (JP)

(73) Assignee: Sharp Kabushiki Kaisha, Osaka (JP)

( * ) Notice: Subject to any disclaimer, the term of this patent is extended or adjusted under 35 U.S.C. 154(b) by 290 days.

(21) Appl. No.: 11/812,469

(22) Filed: Jun. 19, 2007

(65) Prior Publication Data

US 2007/0292169 A1 Dec. 20, 2007

(30) Foreign Application Priority Data

Jun. 20, 2006 (JP) ..... 2006-170724

(51) Int. Cl.
*G03G 15/01* (2006.01)

(52) U.S. Cl. ..... 399/223; 399/298

(58) Field of Classification Search ..... 399/298, 399/302, 223

See application file for complete search history.

(56) References Cited

U.S. PATENT DOCUMENTS 5,627,629 A * 5/1997 Takahashi et al. ..... 399/231
5,659,857 A 8/1997 Yamazaki et al.
7,489,890 B2 * 2/2009 Fujisawa et al. ..... 399/223
2004/0072091 A1 4/2004 Mochizuki et al.
2005/0221214 A1 10/2005 Nagahama et al.

FOREIGN PATENT DOCUMENTS

| | | | |
|---|---|---|---|
| JP | 02-187770 | | 7/1990 |
| JP | 04-070853 | | 3/1992 |
| JP | 3066943 | | 5/2000 |
| JP | 2004-45668 | | 2/2004 |
| JP | 2004133178 A | * | 4/2004 |
| JP | 2005-134807 | | 5/2005 |
| JP | 2005-292468 | | 10/2005 |

* cited by examiner

*Primary Examiner*—David M Gray
*Assistant Examiner*—Erika Villaluna
(74) *Attorney, Agent, or Firm*—Nixon & Vanderhye, PC

(57) ABSTRACT

There is provided a color image forming apparatus which is capable of preventing fogging, and decrease of a transfer efficiency of a toner image onto a recording medium when forming a color image, and stably forming a high-definition color image excellent in a color reproducibility. In a color image forming apparatus including a toner image forming section, a transfer section, a fixing section, a recording medium feeding section, and a discharging section, respective color toners which are used in the toner image forming sections are adapted to have different time constants τ from each other.

3 Claims, 1 Drawing Sheet

COLOR IMAGE FORMING METHOD AND COLOR IMAGE FORMING APPARATUS

CROSS-REFERENCE TO RELATED APPLICATION

This application claims priority to Japanese Patent Application No. 2006-170724, which was filed on Jun. 20, 2006, the contents of which are incorporated herein by reference in its entirety.

BACKGROUND OF THE TECHNOLOGY

1. Field of the Technology

The present technology relates to a color image forming method and a color image forming apparatus.

2. Description of the Related Art

In an image forming method utilizing an electrophotographic process, there is typically used a method including an image forming step of forming a toner image, a transfer step of transferring the toner image onto a recording medium, and a fixing step of fixing the toner image on the recording medium. In the image forming step, a photoreceptor drum having a surface of a photosensitive layer is used, and the surface of the photoreceptor drum is evenly charged and thereafter the surface in a charged state is exposed to light in accordance with signals corresponding to image information. An electrostatic latent image is formed by the exposure. Thereafter, by supplying a toner to the electrostatic latent image on the photoreceptor drum, a toner image is formed. In the transfer step, the toner image formed at the image forming step is transferred onto a recording medium directly or via an intermediate transfer medium. At the fixing step, the toner image on the recording medium is fixed, for example, by heating and pressing. In addition, when a color image is formed, a plurality of image forming steps of forming a toner image are provided using toners of various colors, toner images of different colors which have been formed at the respective image forming steps are transferred on the intermediate transfer medium or recording medium by sequentially overlaying one by one at a predetermined position of the intermediate transfer medium or recording medium. Consequently a multicolor toner image which is a multilayered lamination structure of the different color toner images is formed. The multicolor toner image is fixed on the recording medium to produce the color image.

In order to form the multicolor toner image, a typical image forming apparatus has a configuration in which a plurality of image forming units for carrying out the image forming step are arranged in a line from upstream to downstream of the image forming apparatus, in a rotational direction of a recording medium transporting medium or the intermediate transfer medium which is arranged so as to rotate, and a photoreceptor drum of each of the image forming units provides pressure contact with the recording medium transporting medium or the intermediate transfer medium, and the toner images on the surfaces of the photoreceptor drums are transferred onto the recording medium transported by the recording medium transporting mechanism or the intermediate transfer medium sequentially from an upstream side image forming unit. In this configuration, a time period from the transfer of the toner image formed in the image forming unit onto the recording medium or the intermediate transfer medium until fixing the transferred image on the recording medium, depends on the toner image. The toner image is also a toner aggregate whose shape is maintained by electrostatic attraction. Therefore, even though the time period from the transfer onto the intermediate transfer medium to the fixing thereto is changed in a greater or less degree, a change in shape visible to the naked eye does not occur. However, when the multicolor toner image is formed, there is provided a configuration in which the toner image transferred is further laminated with another toner image and then transferred. Therefore, a physical stress produced when the toner image is laminated and transferred facilitates dispersion of a part of the toner from the toner image, and increases a degree of the dispersion of the toner in the toner image transferred first. Accordingly, it is impossible to prevent a difference in the degree of the dispersion of the toner depending on the toner image. In particular, the toner image transferred first significantly has the above-described tendency, and has a difference in the degree of the dispersion of the toner from that of the toner image transferred last. As a result, the color image which is last formed may have insufficient color reproducibility, a color drift, a bold character, uneven image density, uneven image gloss, and the like, to decrease a transfer efficiency of the multicolor image onto the recording medium, resulting in insufficient image quality of the color image. In addition, the toner dispersed from the toner image is attached onto the surfaces of the intermediate transfer medium, the photoreceptor drums, and the like to cause an image failure such as fogging. Further, a difference in the time period from the transfer of the toner to the fixing thereof causes the degree of the dispersion of the toner in the toner image.

Meanwhile, there is proposed a color image forming method in which by using toners having respective colors, having a shape factor SF-1, which represents a degree of irregularity of surfaces of toner particles, of from 100 to 150, and containing low softening point materials such as natural waxes including a paraffin wax, and a polyolefin wax; and synthetic waxes, a plurality of toner images of different colors are formed, and intermediately transferred onto an intermediate transfer medium in a voltage applied state, to produce a multicolor toner image on the intermediate transfer medium, and the multicolor toner image is transferred onto a recording medium by a transfer section in a voltage applied status (refer to Japanese Examined Patent Publication JP-B 3066943, for example). In this color image forming method, in order to, for example, improve a transfer efficiency of the toner image onto the recording medium, and prevent fusion-bonding of the toner to the intermediate transfer medium and the photoreceptor drum, toner filming, and the like, there is provided a configuration in which a shape of the toner is defined as a numerical range of a shape factor SF-1, and a specific low softening point material is contained in the toner, and a voltage is applied to the intermediate transfer medium. However, also in an image forming apparatus for achieving this color image forming method, for example, a color drift, a bold character, uneven image density, and uneven image gloss, and the like are caused on a transferred medium. Furthermore, with respect to maintenance management such as cleaning maintenance for internal contamination of apparatuses caused by the toner dispersion, a longer time period is required than that for apparatuses according to the related art. Moreover, in JP-B 3066943, there is disclosed a technology for improving a transfer efficiency by defining a shape of the toner, but no suggestion of a technology, in particular, for preventing toner contamination of the intermediate transfer medium, caused by a change in shape of the toner image on the intermediate transfer medium.

Furthermore, there are proposed a number of technologies for defining a time constant $\tau$ of a toner in a predetermined range, in order to improve various properties of the toner. There is proposed a toner which uses a resin composition containing, for example, polyester, polyalkylene, a specific polyolefin disperser, and nonoxide polyethylene, as a binder resin, and has a time constant τ in a range of 100 msec to 350 msec (refer to Japanese Unexamined Patent Publication JP-A 2005-292468, for example). The toner disclosed in JP-A 2005-292468 is excellent in a storage property, and thus prevent mutual fusion-bonding, flocculation, and deformation of the toner when placed under heat, and excellent in a flowability, and a transfer property and a fixing property onto a recording medium, and has a tendency not to cause toner filming onto a photoreceptor drum. In a technology disclosed in JP-A 2005-292468, a time constant τ is set to in the above-described range in order to improve a charge property of the toner in a developing device, and is not set in order to prevent the toner from dispersing from a toner image on an intermediate transfer medium. In addition, in JP-B 3066943 and JP-A 2005-292468, there is not disclosed a technological idea that a plurality of toners of different time constants τ in addition to different colors are used upon forming a multicolor toner image.

SUMMARY OF THE TECHNOLOGY

An object of the technology is to provide a color image forming method which is capable of preventing toner contamination on a surface of a photoreceptor drum (occurrence of fogging) and decrease in efficiency of transferring a toner image onto a recording medium, caused by dispersion of the toner from the toner image which is not fixed onto a recording medium, in forming a multicolor toner image or a color image, and is capable of stably forming a high-definition color image excellent in color reproducibility, and having no color drift, no bold character, no uneven image density and no uneven image gloss; as well as an image forming apparatus capable of realizing the method.

The technology provides a color image forming method, comprising:

a plurality of image forming steps of forming toner images of different colors;

a transfer step of sequentially overlaying one by one the plurality of toner images of different colors formed at the respective image forming steps, transferring the toner images onto a recording medium, and allowing the recording medium to bear a multicolor toner image as a laminated body of the toner images of different colors; and a fixing step of fixing the multicolor toner image onto the recording medium, wherein a toner having a different time constant is used with respect to each image forming step.

In the color image forming method comprising the plurality of image forming steps of forming toner images of different colors; the transfer step of sequentially overlaying one by one the plurality of toner images of different colors formed at the respective image forming steps, and transferring the toner images onto the recording medium; and the fixing step of fixing the multicolor toner image onto the recording medium, by using the toner having a different time constant with respect to each image forming step, a difference in a degree of dispersion of the toner between the toner image transferred first and the toner image transferred last is not produced, and the difference in the degree of dispersion is not produced even though a time period from a transfer of the toner image onto the recording medium to a fixing thereof is changed, and the dispersion itself of the toner from the toner image is decreased. Therefore, according to the color image forming method, toner contamination of the recording medium, toner contamination of the surface of the photoreceptor and occurrence of an image failure such as fogging because of them, a decrease in a transfer efficiency of the toner image onto the recording medium, and the like are prevented, and a high-definition color image excellent in a color reproducibility is stably formed. Furthermore, a color drift, a bold character, uneven image density, uneven image gloss, and the like are not caused.

Further, it is preferable that the transfer step includes an intermediate transfer step of sequentially overlaying one by one the plurality of toner images of different colors formed at the respective image forming steps on an intermediate transfer medium to form the multicolor toner image as the laminated body of the toner images of different colors; and a secondary transfer step of transferring the multicolor toner image onto the recording medium.

In the color image forming method, the transfer step includes the intermediate transfer step of transferring the multicolor toner image onto the intermediate transfer medium; and the secondary transfer step of transferring the multicolor toner image onto the recording medium. Accordingly, toner contamination of the surface of the photoreceptor, occurrence of an image failure such as fogging, a decrease in a transfer efficiency of the toner image onto the recording medium, and the like are prevented, and a high-definition color image excellent in a color reproducibility is stably formed, and toner contamination of the recording medium is further reduced.

Further, it is preferable that the image forming step includes a charging step of charging a photosensitive layer on a surface of a photoreceptor; an exposure step of exposing the surface of the photoreceptor to light in accordance with signals corresponding to image information to form an electrostatic latent image; and a developing step of developing the electrostatic latent image to form the toner image by using a developer containing the toner.

The image forming step preferably includes the charging step of charging the surface of the photoreceptor, the exposure step of forming the electrostatic latent image on the surface of the photoreceptor, and the developing step of developing the electrostatic latent image on the surface of the photoreceptor by using the toner.

Further, it is preferable that the lower a layer of the toner images is disposed, the larger time constants of the toners contained in the plurality of toner images constituting the multicolor toner image are.

Upon obtaining the multicolor toner image as the laminated body of the toner images by transferring the plurality of toner images onto the same position, the lower a layer of the toner images is disposed, the larger the time constants τ of the toners constituting the toner image are selected. Accordingly, an effect to change the time constant τ with respect to each toner is further enhanced, further preventing a decrease in its transfer efficiency and occurrence of fogging.

Further, it is preferable that at the image forming step, a black toner image which is composed of a black toner; and the one or more toner images which are composed of the one or more toner having a color other than black are formed, and the time constant of the black toner is smaller than those of the one or more toners having a color other than black.

At the image forming step, when the plurality of toner images are formed by using the plurality of toners of different colors including the black toner, the time constant τ of the black toner is decreased lower than the time constants τ of the other toners. Accordingly, even though a process rate upon an image forming is increased 1.5 times to 2 times higher than a process rate upon a typical image forming for a monochromatic print, occurrence of image failures such as fogging caused by toner contamination of the surface of the photoreceptor, a decrease in a transfer efficiency of the toner image onto the recording medium, and the like are prevented, and thereby a high-definition image having a good color reproducibility is stably formed.

Further, it is preferable that at the image forming step, a two-component developer containing a toner having a shape factor SF1 and a shape factor SF2 of 160 or less, respectively; and a carrier containing a carrier having a coating layer containing polyolefin on an entire surface or a part of the surface thereof is used to form the toner image.

Further, it is preferable that the toner is a black toner.

At the image forming step, by using the two-component developer containing the toner (preferably the black toner) having a shape factor SF1 and a shape factor SF2 of 160 or less, respectively; and the carrier containing the carrier having the coating layer containing polyolefin on the entire surface or a part of the surface thereof, the toner image is formed. Accordingly, van der Waals force among toner particles is decreased, and thereby a transfer efficiency of the toner image onto the recording medium is further improved.

Further, the technology provides a color image forming apparatus, comprising:

a plurality of image forming sections for forming toner images of different colors;

a transfer section for sequentially overlaying one by one the toner images of different colors which are formed in the respective image forming sections and transferring the toner images onto a recording medium to allow the recording medium to bear a multicolor toner image thereon; and a fixing section for fixing the multicolor toner image onto the recording medium, wherein the plurality of image forming sections use toners of different time constants.

There is provided the color image forming apparatus comprising the plurality of image forming sections for forming the toner images of different colors; the transfer section for sequentially overlaying one by one the toner images of different colors and transferring the toner images to allow the recording medium to bear the multicolor toner image thereon; and the fixing section for fixing the multicolor toner image onto the recording medium, wherein the plurality of image forming sections use the toners having the different time constants. According to the color image forming apparatus, a high-definition color image having no image failure such as fogging, and a good color reproducibility is stably formed, and the image quality is not deteriorated even when a process rate at this time is increased 1.5 times to 2 times higher than a process rate of a typical monochromatic image forming apparatus.

Further, it is preferable that the transfer section includes an intermediate transfer section having an intermediate transfer medium, for sequentially overlaying one by one the toner images of different colors which are formed in the respective image forming sections on the intermediate transfer medium and transferring the toner images to allow the intermediate transfer medium to bear the multicolor toner image thereon; and a secondary transfer section for transferring the multicolor toner image on the intermediate transfer medium onto the recording medium.

In the color image forming apparatus, the transfer section includes the intermediate transfer section having the intermediate transfer medium, for forming the multicolor toner image on the intermediate transfer medium; and the secondary transfer section for transferring the multicolor toner image on the intermediate transfer medium onto the recording medium. Accordingly, toner attachment to a non-image forming area on the intermediate transfer medium and the recording medium is further reduced, and occurrence of image failures such as fogging is further prevented.

BRIEF DESCRIPTION OF THE DRAWINGS

Other and further objects, features, and advantages will be more explicit from the following detailed description taken with reference to the drawings wherein.

DETAILED DESCRIPTION

Figure 1:
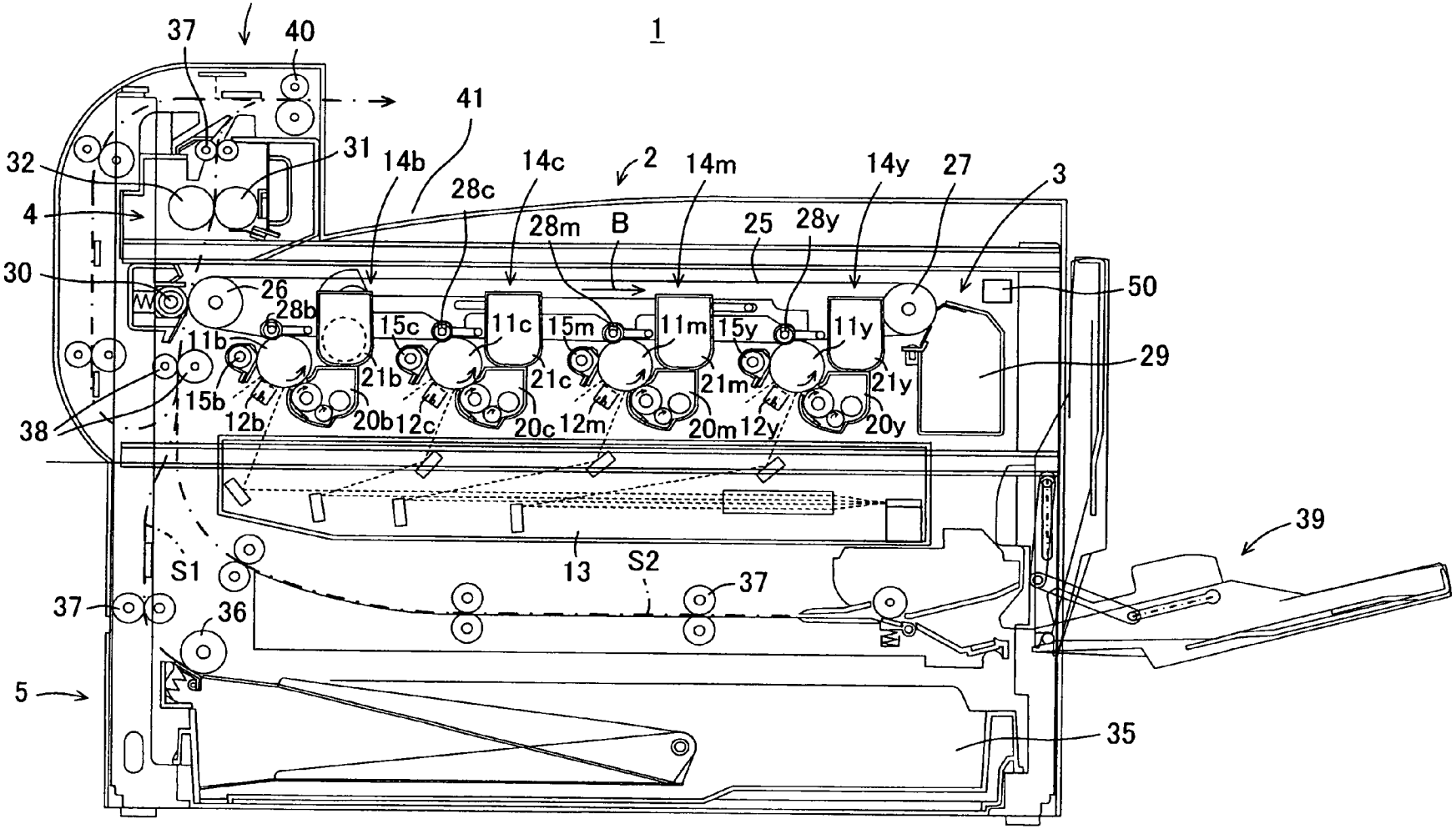
FIG. 1 is a cross-section view schematically illustrating a configuration of an image forming apparatus according to a first embodiment.

Hereinafter, referring to the drawing, preferred embodiments are described in detail.

FIG. 1 is a cross-section view schematically illustrating a configuration of an image forming apparatus 1 according to a first embodiment. The image forming apparatus 1 is a multifunction machine having a copying function, a printing function, and a facsimile function in combination, and forms a full-color image or a monochromatic image on a recording medium corresponding to image information transmitted thereto. That is, in the image forming apparatus 1, three kinds of print modes called a copier mode (a copying mode), a printer mode, and a FAX mode are provided, and the print mode is selected by a control unit 50 in accordance with an operation input from an operation portion (not shown), and reception of a print job from external host devices such as a personal computer, and external devices using a wired transmission, a radio transmission, and a memory unit, such as a mobile device, and an information recording storage medium. The image forming apparatus 1 comprises a toner image forming section 2, a transfer section 3, a fixing section 4, a recording medium feeding section 5, and a discharging section 6. Respective members constituting the toner image section 2, and some members included in the intermediate transfer section 3 are arranged by four pieces, respectively, in order to correspond to image information of respective colors of black (b), cyan (c), magenta (m), and yellow (y). Here, each member of four members corresponding to each color is identified by giving an alphabet representing each color to an end of a reference numeral, and when four members are collectively designated, they are designated only by a reference numeral.

The toner image forming section 2 includes photoreceptor drums 11, charging sections 12, an exposure unit 13, developing sections 14, and cleaning units 15. The charging sections 12, the developing sections 14, and the cleaning units 15 are arranged in this order around the photoreceptor drums 11, respectively. The charging sections 12 are arranged below the developing sections 14 and the cleaning units 15 in a vertical direction. Note that in the embodiment, a configuration providing the cleaning units 15 is described, but a configuration without providing the cleaning units 15 may be possible.

The photoreceptor drum 11 is supported to rotate around an axis by a driving mechanism (not shown), and includes a conductive base (not shown), and a photosensitive layer (not shown) which is formed on a surface of the conductive base. The conductive base may have various shapes, including a cylindrical shape, a columnar shape, and a thin film sheet shape, for example. Among these shapes, preferable is the cylindrical shape.

The conductive base is composed of a conductive material. As the conductive material, ingredients commonly used in this field may be used, including, for example, metal such as aluminum, copper, brass, zinc, nickel, stainless steel, chromium, molybdenum, vanadium, indium, titanium, gold, and platinum; alloy composed of two or more of these ingredients; a conductive film obtained by forming a conductive layer composed of one or two or more selected from aluminum, an aluminum alloy, a tin oxide, gold, an indium oxide, on a film base such as a synthetic resin, a metal film, or paper; and a resin composition containing conductive particles and/or a conductive polymer. Note that as the film base used for the conductive film, a synthetic resin film is preferable, and a polyester film is especially preferable. In addition, as a method for forming the conductive layer on the conductive film, a vapor deposition method, a coating method, or the like is preferable.

The photosensitive layer is formed, for example, by laminating a charge generating layer containing a charge generating substance, and a charge transporting layer containing a charge transporting substance. At this time, an undercoat layer is preferably disposed between the conductive base and the charge generating layer or the charge transporting layer. By disposing the undercoat layer, there are obtained advantages including a smoothing of a surface of the photosensitive layer by coating a flaw and an irregularity on a surface of the conductive base, prevention of deterioration in a charge property of the photosensitive layer when being repeatedly used, and improvement of a charge property of the photosensitive layer in a low temperature and/or low humidity environment. In addition, the photosensitive layer may be a laminated photoreceptor having a photoreceptor surface protection layer disposed as the most surface layer thereof, an enhanced durability, and a three-layer structure.

The charge generating layer is primarily composed of the charge generating substance which generates a charge by light irradiation, and contains as appropriate heretofore known ingredients such as a binder resin, a plasticizer, and a sensitizer. As the charge generating substance, ingredients commonly used in this field may be used, including, for example, perylene pigments such as perylene imide and perylene acid anhydride; polycyclic quinone pigments such as quinacridone, and anthraquinone; phthalocyanine compounds such as metal phthalocyanine, non-metal phthalocyanine, and non-metal phthalocyanine halide; and azo pigments having a squalirium dye, an azulenium dye, a thiapirylium dye, a carbazole framework, a styryl stilbene framework, a triphenyl amine framework, a dibenzothiophene framework, an oxadiazole framework, a fluorenone framework, a bisstilbene framework, a distyryl oxadiazole framework, or a distyryl carbazole framework. Among these charge generating substances, a non-metal phthalocyanine dye, an oxotitanyl phthalocyanine dye, a bisazo dye containing a fluorine ring and/or a fluorenone ring, a bisazo dye composed of aromatic amine, and a trisazo dye have a high charge generation ability, and suitable for obtaining the photosensitive layer having a high sensitivity. These charge generating substances may be used alone or in combination of two or more. A content of the charge generating substance is not limited to a particular level, and is preferably 5 parts to 500 parts by weight, and more preferably 10 parts to 200 parts by weight, based on 100 parts by weight of the binder resin contained in the charge generating layer. As the binder resin used for the charge generating layer, ingredients commonly used in this field may be used, including, for example, a melamine resin, an epoxy resin, a silicone resin, polyurethane, an acrylic resin, a vinyl chloride-vinyl acetate copolymer resin, polycarbonate, a phenoxy resin, polyvinyl butyral, polyalylate, polyamide, and polyester. These binder resins may be used alone or in combination of two or more as needed.

The charge generating layer can be formed by dissolving or dispersing appropriate amounts of the charge generating substance and the binder resin, as needed, the plasticizer and the sensitizer, respectively, into an organic solvent capable of dissolving or dispersing these components to prepare a charge generating layer coating solution, and applying the charge generating layer coating solution onto the surface of the conductive base and drying it. A thickness of the charge generating layer obtained by doing as described above is not limited to a particular level, and preferably 0.05 μm to 5 μm, and more preferably 0.1 μm to 2.5 μm.

The charge transporting layer laminated on the charge generating layer contains, as critical components, a charge transporting substance having an ability to receive a charge generated from the charge generating substance and transport it, and a binder resin for the charge transporting layer, and contains, as needed, heretofore known ingredients such as an antioxidizing agent, the plasticizer, the sensitizer, and a lubricant agent. As the charge transporting substance, ingredients commonly used in this field may be used, including, for example, electron-releasing substances such as poly-N-vinylcarbazole and a derivative thereof, poly-γ-carbazolylmethylglutamate and a derivative thereof, pyrene-formaldehyde condensate and a derivative thereof, polyvinylpyrene, polyvinylphenanthrene, an oxazole derivative, an oxadiazole derivative, an imidazole derivative, 9-(p-diethylaminostyryl) anthracene, 1,1-bis(4-dibenzylaminophenyl)propane, styrylanthracene, styrylpyrazoline, a pyrazoline derivative, phenylhydrazones, a hydrazone derivative, a triphenylamine compound, a tetraphenyldiamine compound, a triphenylmethane compound, a stilbene compound, and an azine compound having a 3-methyl-2-benzothiazolin ring; and electron-accepting substances such as a fluorenone derivative, a dibenzothiophene derivative, a indenothiophene derivative, a phenanthrenequinone derivative, an indenopyridine derivative, a thioxanthone derivative, a benzo[c]cinnoline derivative, a phenazineoxide derivative, tetracyanoethylene, tetracyanoquinodimethane, promanyl, chloranil, and benzoquinone. These charge transporting substances may be used alone or in combination of two or more. A content of the charge transporting substance is not limited to a particular level, and is preferably 10 parts to 300 parts by weight, and more preferably 30 parts to 150 parts by weight, based on 100 parts by weight of the binder resin contained in the charge transporting substance.

As the binder resin for the charge transporting substance, ingredients commonly used in this field, and capable of evenly dispersing the charge transporting substance may be used, including, for example, polycarbonate, polyarylate, polyvinylbutyral, polyamide, polyester, polyketone, epoxy resin, polyurethane, polyvinylketone, polystyrene, polyacrylamide, phenol resin, phenoxy resin, polysulphone resin, and copolymer resin of these substances. Among these substances, preferable are polycarbonate containing bisphenol Z as a monomer (hereinafter, referred to as "bisphenol Z type polycarbonate"), a mixture of the bisphenol Z type polycarbonate and another polycarbonate, and the like. These binder resins may be used alone, or in combination of two or more.

The charge transporting layer preferably contains the antioxidizing agent, together with the charge transporting substance and the binder resin for the charge transporting layer. As the antioxidizing agent, ingredients commonly used in this field may be used, including, for example, vitamin E, hydroquinone, hindered amine, hindered phenol, paraphenylenediamine, arylalkane and derivatives of these substances, an organic sulfur compound, an organic phosphorous compound, and the like. These antioxidizing agents may be used alone or in combination of two or more. A content of the antioxidizing agent is not limited to a particular level, and is preferably 0.01% to 10% by weight, and more preferably 0.05% to 5% by weight, based on a total mount of components constituting the charge transporting layer. The charge transporting layer can be formed by dissolving or dispersing appropriate amounts of the charge transporting substance and the binder resin, as needed, the antioxidizing agent, the plasticizer, and the sensitizer, respectively, into an organic solvent capable of dissolving or dispersing these components to prepare the charge generating layer coating solution, and applying the charge generating layer coating solution onto the surface of the charge generating layer and drying it. A thickness of the charge generating layer obtained by doing as described above is not limited to a particular level, and is preferably 10 μm to 50 μm, and more preferably 15 μm to 40 μm. Note that a photosensitive layer having the charge generating layer and the charge transporting layer in one layer may be formed. In this case, a kind and a content of the charge generating substance and the charge transporting substance, a kind of the binder resin, other additive agents, and the like may be similar to those in a case in which the charge generating layer and the charge transporting layer are formed separately.

In the embodiment, there are used the photoreceptor drums configured by forming an organic photosensitive layer using the charge generating substance and the charge transporting substance as described above, but instead of those photoreceptor drums, photoreceptor drums configured by forming an inorganic photosensitive layer using silicon or the like may be used.

The charging section 12 is arranged so as to face the photoreceptor drum 11 and be separated having a space from the surface of the photoreceptor drum 11 along an elongated direction of the photoreceptor drum 11, and allow the surface of the photoreceptor drum 11 to be charged to predetermined polarity and voltage. As the charging section 12, a brush type charging device, a charger type charging device, and a scorotron type charging device, an ion generation device, or the like may be used. In the embodiment, the charging section 12 is, but not exclusively, arranged so as to be separated from the surface of the photoreceptor drum 11. For example, a charging roller is used as the charging section 12, and may be arranged such that the charging roller is in pressure contact with the photoreceptor drum, and a charging method in which a charging brush, a magnetic brush, or the like is in contact with the photoreceptor may be used.

The exposure unit 13 is arranged such as to irradiate the surfaces of the photoreceptor drums 11 with light beams corresponding to the respective pieces of color information emitted from the exposure unit 13, which light beams pass through a gap between the charging sections 12 and the developing sections 14, respectively. The exposure unit 13 splits light corresponding to the image information into light beams corresponding to the respective pieces of color information of b, c, m, and y therein, expose the surfaces of the photoreceptor drums 11 charged to even potentials by the charging sections 12 with the light beams corresponding to the respective pieces of color information to form electrostatic latent images thereon. For example, a laser scanning unit having a laser irradiation portion and a plurality of reflecting mirrors may be used for the exposure unit 13. In addition, a LED array may be used, and a liquid crystal shutter and a suitable light source may be used in combination.

The developing section 14 includes a developer tank 20 and a toner hopper 21. The developer tank 20 is arranged so as to face the surface of the photoreceptor drum 11, supplies toner to the electrostatic latent image formed on the surface of the photoreceptor drum 11 and develops the toner to form a toner image as a visible image. Inside the developer tank 20, a developing roller is arranged at a position facing the photoreceptor drum 11 in an opening of the developer tank 20 to rotate. The developing roller is a roller-shaped member which supplies the toner to the electrostatic latent image on the photoreceptor drum 11. In addition, a supplying roller and an agitating roller are provided together with the developing roller. The supplying roller is a roller-shaped member which is arranged so as to face the developing roller and be rotatable, and supplies the toner to the periphery of the developing roller. The agitating roller is a roller-shaped member which is arranged so as to face the supplying roller and be rotatable, and supplies a toner newly supplied from the toner hopper 21 into the developing tank 20, to the periphery of the supplying roller. The toner hopper 21 is arranged such that a toner replenishing port (not shown) arranged in a lower part thereof in a vertical direction is linked to communicate with a toner receiving port (not shown) arranged in an upper part of the developer tank 20 in a vertical direction, and replenishes the toner in accordance with a toner consumption state of the developer tank 20. In addition, the developing section 14 may be configured so as to directly replenish the toner from respective color toner cartridge, instead of using the toner hopper 21.

The toners used in developing sections 14*y*, 14*m*, 14*c*, and 14*b* are a yellow toner, a magenta toner, a cyan toner, and a black toner, respectively, and have different time constants τ. The time constant τ is a physical property that is an indication representing a time period required for charging a toner. By configuring such that the time constants τ of the four color toners which are used in the plurality of developing sections 14*y*, 14*m*, 14*c*, and 14*b* are different from each other, dispersion of the toners from the toner images, caused by lamination of the toner images, a time deference from a transfer of the toner images onto an intermediate transfer belt 25 to a fixing onto the recording medium, or the like, are prevented.

In the embodiment, the developing sections 14*y*, 14*m*, 14*c*, and 14*b* are arranged in this order from an upstream side to a downstream side in a rotational driving direction of the intermediate transfer belt 25 (a direction of an arrow B). Therefore, the time constant τ of the black toner which is used in the developing section 14*b* located on the most downstream side is adapted to be the smallest of those of the four color toners. The time constant τ is increased toward the upstream side. The time constant τ of the yellow toner which is used in the developing section 14*y* located on the most upstream side is thus adapted to be the largest of those of the four color toners. That is, the time constants τ of the respective color toners are increased in an order of black, cyan, magenta, and yellow. When the four color toner images are overlaid one by one to laminate them, the toner image composed of the black toner is located in the top layer, and then the toner image composed of the cyan toner, the toner image composed of the magenta toner, and the toner image composed of the yellow toner are sequentially laminated thereon in this order, and thus the toner image composed of the yellow toner is located in the lowest layer.

The time constants of the respective color toners are not limited to particular levels, and may be selected as appropriate in view of a relative relationship with the other toners. As one example of the time constants of the respective colors, the time constants of the black toner, the cyan toner, the magenta toner, and the yellow toner may be selected from ranges of 350 msec to 950 msec, of 400 msec to 1150 msec, of 450 msec to 1400 msec, and of 600 msec to 1600 msec, respectively. As described above, when the time constants τ of the respective toners are configured so as to have the above-described relationship, in addition to only preventing dispersion of the toner from the toner image, it is possible to stably form a high-definition color image, even though a process rate of the image forming apparatus 1 is increased, for example, by increasing the process rate upon forming a color image in the image forming apparatus 1 around 1.5 times to 2 times higher than the process rate upon forming an image in a monochromatic image forming apparatus.

The time constant τ (msec) of the toner is herein obtained according to the following. First, the toner is a dielectric substance, and thus has a resistance component and a capacitance (capacitor) component both. When resistance of the toner is taken as R(Ω), and capacitance of the toner is taken as C(F), a state that a voltage is applied to the toner can be compared to a circuit in which the resistance R(Ω) and the capacitor C(F) are connected in series. A direct-current voltage E(V) is applied to this series circuit. A moment at which the voltage E is applied is taken as time 0, a current that flows in the circuit at time t is taken as i(t) (A), and a charge amount of the capacitor is taken as q(t) (C, coulomb). At this time, an equation of the circuit is expressed as follows:

$$E=R\times i(t)+q(t)/C \tag{1}$$

Here, a current is a flow of an electron, that is, a magnitude of a time change in charge amount. Therefore, the current is expressed as i(t)=dq(t)/dt, and the equation (1) can be changed to a differential equation with respect to the charge amount q(t) as follows:

$$E=[(R\times dq(t)/dt)+q(t)]/C \tag{2}$$

By solving the equation (2), it is found that q(t) can be expressed as an exponential function with respect to time t according to the following equation (3):

$$q(t)=CE(1-\exp(-t/RC)) \tag{3}$$

Moreover, when a voltage across the capacitor is taken as ec(t), q(t)=C×ec(t) and thus the following relational expression is obtained:

$$ec(t)=E(1-\exp(-t/\tau)) \tag{4}$$

[where, τ=RC]

Here, the product of R and C is the time constant τ of the circuit. Therefore, when the resistance of the toner is taken as R, and the capacitance of the toner is taken as C, the product RC is defined as the time constant τ of the toner. According to the expression (4), the larger the time constant τ is, the longer a time period that ec (t) takes to reach its maximum value E becomes. The time constant τ is proportional to the resistance R and the capacitance (charge amount) C of the toner. Therefore, the larger the charge amount induced by the resistance component or the capacitance component of the toner is, the longer a time needed for an electrical discharge of the toner becomes. That is, a decrease in frictional electrification of the toner is delayed. In order to obtain the time constant τ, an alternating current rectangular wave, instead of ON/OFF of a direct-current power supply, is applied to the circuit. Actually, the time constant τ was obtained by using a dielectric loss measurement apparatus (trade name: TRS-10T type, manufactured by Ando Electric Co., Ltd.), and measuring the resistance (R) and the capacitance (C) of the toner.

The time constant τ of the toner can be adjusted by selecting as appropriate kinds and contents of the respective components contained in the toner. Examples of the respective components contained in the toner include a binder resin, a colorant, a charge control agent, a release agent, an organic additive agent, and an inorganic additive agent.

As the binder resin, ingredients commonly used in this field may be used, including, for example, a styrene copolymer, polyvinyl chloride, a phenol resin, a natural modified phenol resin, a natural modified maleic acid resin, an acrylic resin, a methacrylic resin, polyvinyl acetate, a silicone resin, polyester, polyurethane, a polyamide resin, a fran resin, an epoxy resin, a xylene resin, polyvinylbutyral, a terpene resin, a coumarone-indene resin, a oil resin, and a graft resin of these resins. In addition, two or more resins of these may be used in combination.

As the colorant, ingredients commonly used in this field may be used, including, for example, a yellow toner colorant, a magenta toner colorant, a cyan toner colorant, and a black toner colorant. Examples of the yellow toner colorant include azo pigment such as C.I. pigment yellow 1, C.I. pigment yellow 5, C.I. pigment yellow 12, C.I. pigment yellow 15, and C.I. pigment yellow 17, each classified according to its color index; inorganic pigment such as yellow iron oxide, and yellow ocher; nitro dyes such as C.I. acid yellow 1; and oil-soluble dyes such as C.I. solvent yellow 2, C.I. solvent yellow 6, C.I. solvent yellow 14, C.I. solvent yellow 15, C.I. solvent yellow 19, C.I. solvent yellow 21.

Examples of the magenta toner colorant include C.I. pigment red 49, C.I. pigment red 57, C.I. pigment red 81, C.I. pigment red 122, C.I. solvent red 19, C.I. solvent red 49, C.I. solvent red 52, C.I. basic red 10, and C.I. disperse red 15, each classified according to its color index.

Examples of the cyan toner colorant include C.I. pigment blue 15, C.I. pigment blue 16, C.I. solvent blue 55, C.I. solvent blue 70, C.I. direct blue 25, and C.I. direct blue 86, each classified according to its color index.

Examples of the black toner colorant include carbon black such as channel black, roller black, disk black, gas furnace black, oil furnace black, thermal black, and acethylene black. Suitable carbon black may be selected as appropriate from various kinds of carbon black according to a design property of the toner to be obtained.

These colorants may be used alone or in combination of two or more. Further, two or more of the colorants having the same colors may be used in combination, and one or two or more of the colorants of different colors may be used in combination. A usage of the colorant is not limited to a particular level, and is preferably 5 parts to 20 parts by weight based on 100 parts by weight of the binder resin. By using the colorant in this range, it is possible to form an excellent high-definition image having high image density without reducing respective physical properties of the toner.

As the charge control agent, it is possible to use agents for controlling positive charges and agents for controlling negative charges, which are commonly used in this field. Examples of the charge control agent for controlling positive charges include a basic dye, quaternary ammonium salt, aminopyrine, a pyrimidine compound, a polynuclear polyamino compound, aminosilane, and a nigrosine dye. Examples of the charge control agent for controlling negative charges include oil-soluble dyes such as oil black and spiron black, a metal-containing azo compound, metal salt naphthenate, metal salt salicylate, a fatty acid soap, and a resin acid soap. The charge control agent may be used alone, or in combination of two or more as needed. A usage of the charge control agent is not limited to a particular level, and may be selected as appropriate from a wide range. A preferable usage of the charge control agent is 0.5 part to 3 parts by weight based on 100 parts by weight of the binder resin.

As the release agent, ingredients commonly used in this field may be used, including, for example, petroleum waxes such as a paraffin wax and a derivative thereof, and a microcrystalline wax and a derivative thereof; hydrocarbon synthesis waxes such as a Fischer-Tropsch wax and a derivative thereof, a polyolefin wax and a derivative thereof, and a low-molecular polypropylene wax and a derivative thereof, and a low-molecular polyethylene wax and a derivative thereof; plant-derived waxes such as a carnauba wax and a derivative thereof, a rice wax and a derivative thereof, a candelilla wax and a derivative thereof, and a wood wax; animal-derived wax such as a bee wax and a whale wax; oil and fat synthesis waxes such as fatty acid amide and phenol fatty acid ester; long-chain carboxylic acid and a derivative thereof; and long-chain alcohol and a derivative thereof. Note that the derivative includes an oxide, a block copolymer of a vinylic monomer and a wax, and a graft denatured product of a vinylic monomer and a wax. Further, an oxide wax and a nonoxide wax may be used as appropriate. A usage of the wax is not limited to a particular level, and may be selected as appropriate from a wide range. A preferable usage of the wax is 0.2 part to 20 parts by weight based on 100 parts by weight of the binder resin.

The toner can be manufactured according to heretofore known methods, including, for example, a pulverizing method, a suspension polymerization method, an emulsion polymerization method, a solution polymerization method, a mass polymerization method, and a precipitation polymerization method. For example, according to the pulverizing method, predetermined amounts of a binder resin, a colorant, a release agent, and a charge control agent, and the like are mixed, and the resultant mixture is melt-kneaded, and a solidified material of the resultant melt-kneaded material is pulverized and classified to produce a toner. According to the suspension polymerization method, polymerizable vinyl bond-containing monomers such as vinyl acetate, styrene, and (meta)acrylic acid ester; a colorant; a release agent; and a charge control agent are dispersed into water or a water-based solvent obtained by mixing an appropriate amount of organic solvent with water, and polymerized with the polymerizable vinyl bond-containing monomer under the presence of a polymerization starter to produce a toner. Upon this polymerization reaction, by adding appropriate amounts of water-soluble polymers such as gelatin, starch, polyvinyl alcohol, and carboxymethyl cellulose; and poor water-soluble inorganic compounds such as calcium carbonate, and magnesium carbonate to the reaction system, it is possible to uniform shapes of obtained toner particles, and prevent forming coarse particles. In order to obtain a toner having a desired time constant in these methods, one or two or more of, for example, an agitating condition upon polymerization, and reaction conditions such as kinds and additive amounts of various kinds of internal additive agents may be selected as appropriate.

Further, the toner which is used in the technology may contain a flow modifier as an additive agent. The flow modifier produces its effect by, for example, attaching it to a surface of the toner. As the flow modifier, ingredients commonly used in this field may be used, including, for example, fluorine compounds such as silica, titanium oxide, silicon carbide, aluminum oxide, strontium, strontium titanate, tetrafluoroethylene; acrylic vinyl resin fine particles; and fatty acid metal salt. The flow modifier whose surface is hydrophobized by, for example, polyorganosiloxane having a trimethylsilyl group may be used. In addition, dimethyl silicone, hexamethyldisilazane, and amino modified silicone may be typically used. The hydrophobizing treatment is preferably applied to, for example, silica or the like. The flow modifier subjected to the hydrophobizing treatment, in particular, silica subjected to the hydrophobizing treatment is typically attached to an electrode of a charging device, or the like, to thereby decrease a chargeability of the photoreceptor drum, thus causing a charge failure. However, by using the charging sections 12, the charge failure, and thus an image failure is eliminated, even though a toner containing silica subjected to the hydrophobizing treatment is used for forming an image. These flow modifiers may be used alone or in combination of two or more. A usage of the flow modifier is not limited to a particular level, and is preferably 0.1 part to 3.0 parts by weight based on 100 parts by weight of the toner particles.

Further, the toners which are used in the developing devices 14*y*, 14*m*, 14*c*, and 14*b* are preferably used in a form of a two-component developer containing a toner and a carrier. At this time, the toners are preferably 160 or less, and more preferably 110 to 160, and especially preferably 130 to 160, with respect to shape factors SF-1 and SF-2 both. The shape factor SF-1 represents a ratio of a roundness of a toner's shape, and is expressed according to the following expression (5):

$$SF\text{-}1=\{(MXLNG)^2/\mathrm{AREA}\}\times(100\pi/4) \quad (5)$$

where, "MXLNG" represents a maximum length of a shape produced by projecting toner particles onto a two-dimensional surface (an absolute maximum length of toner particles), and "AREA" represents a graphic area (a projected area) of toner particles. When SF-1 is below 110, the toner particles have a shape similar to a spherical shape. Accordingly, contact between toner particles, or between toner particles and the photoreceptor drums 11 leads to point contact, to thereby decrease adhesive force between the toner particles and the photoreceptor drums 11, thus improving its transfer efficiency. On the other hand, when SF-1 exceeds 160, shapes of the toner particles become unstable, thus decreasing a developing property and a transfer property.

The shape factor SF-2 is an indication representing a ratio of irregularities of the toner particles, and is obtained by the following expression (6):

$$SF\text{-}2=\{(PERI)^2/\mathrm{AREA}\}\times(100/(4\pi)) \quad (6)$$

where, "PERI" represents a circumference length of a shape produced by projecting toner particles onto a two-dimensional surface. When SF-2 is below 110, irregularities of the surfaces of the toner particles are decreased, resulting in smooth surfaces thereof. In order to improve a cleaning property, the surfaces should have appropriate irregularities. However, when SF-2 becomes more than 160, it is not preferable that the irregularities become apparent to decrease an image quality level due to toner dispersion onto an image, or the like.

Further, the shape factors were specifically obtained by using a scanning electron microscope (trade name: S-800, manufactured by Hitachi, Ltd.), taking an image of the toner at a 5,000-fold magnification, introducing the image to an image analysis apparatus (trade name: LUSEX3, manufactured by Nireco Corp.), analyzing it to obtain "MXLNG", "PERI", and "AREA", and calculating according to the expressions (1) and (2). With respect to the shape factors SF-1 and SF-2, the toner having desired shape factors can be manufactured, for example, in the above-described toner manufacturing methods, by using a mechanical pulverizing method, and a particle collision pulverizing method in the pulverizing methods, or setting an agitating condition as appropriate in the suspension polymerization method.

As the carrier which is used in combination with the toner having the shape factors SF-1 and SF-2 having the above-described range, the carrier having a coating layer containing polyolefin on the entire surface or a part of the surface of the carrier (hereinafter, referred to as a "polyolefin-coated carrier") can be preferably used. The polyolefin-coated carrier is a carrier which is composed by, for example, forming a polyolefin layer on a part of the surface or the entire surface of magnetic particles. Examples of the magnetic particles include ferrite, magnetite, and iron particles. Particle diameters of the magnetic particles are preferably 20 μm to 200 μm, and more preferably 30 μm to 100 μm.

Polyolefin can be coated onto the magnetic particles according to heretofore known methods, including, for example, an atomization method in which a solution composed by dissolving polyolefin into an appropriate organic solvent is sprayed and applied to the magnetic particles, a fusion fixing method, and a surface polymerization method. The surface polymerization is a method in which, for example, the magnetic particles bearing a polyolefin polymerization catalyst on surfaces thereof, and a polyolefin monomer are added to an appropriate organic solvent, and the resultant appropriate organic solvent is heated to polymerize the polyolefin monomer on the surfaces of the magnetic particles, and is disclosed in JP-A 2-187770 (1990), and JP-A 4-70853 (1992), for example. An amount of polyolefin coated to the magnetic particles is preferably 1 to 20% by weight, and more preferably 3% to 10% by weight, based on a total amount of the magnetic particles and polyolefin.

Further, a carrier which is coated with a resin other than polyolefin may be used. Examples of the resin other than polyolefin include vinyl resins such as a silicone resin, a fluorine resin, and an acrylic resin. One or two or more selected from inorganic particles, an inorganic charge-giving agent, an organic charge-giving agent, and the like may be added into these resins. Examples of the inorganic particles include carbon black, alumina, and titanium. As the inorganic charge-giving agent and the organic charge-giving agent, ingredients of different polarities from a toner are preferable. In addition, a typical carrier which is not coated with polyolefin may be used in combination.

Resistivity of the carrier is preferably $10^8$ Ω·cm or more, and more preferably $10^{12}$ Ω·cm or more. The resistivity is a value which is obtained by putting particles into a container having a cross-section area of 0.50 $cm^2$ and tapping them, and then by applying a load of 1 $kg/cm^2$ onto the particles filled in the container, and reading a current value when applying a voltage that produces an electrical field of 1000 V/cm between the load and a bottom electrode. When the resistivity is low, a charge is infused to the carrier upon applying a bias voltage to the developing roller, and thereby the carrier particles have a tendency to attach to the surfaces of the photoreceptor drums, and have a tendency to cause a breakdown of the bias voltage. Magnetization intensity (maximum magnetization) of the carrier is preferably 10 emu/g to 60 emu/g, and more preferably 15 emu/g to 40 emu/g. A usage ratio of the carrier to the toner in the two-component developer is not limited to a particular level, and may be selected as appropriate according to kinds of the toner and the carrier. Taking the polyolefin-coated carrier (density: 5 $g/cm^2$ to 8 $g/cm^2$) for example, the toner may be used such that the toner is contained in the developer by 2% to 30% by weight, more preferably 2% to 20% by weight based on a total amount of the developer.

The cleaning unit 15 removes a residual toner remaining on the surface of the photoreceptor drum 11 after transferring toner image onto the intermediate transfer belt 25, to clean the surface of the photoreceptor drum 11. For example, a plate-shaped member such as a cleaning blade is used for the cleaning unit 15. In addition, in the image forming apparatus, an organic photoreceptor drum is mainly used as the photoreceptor drum 11, and a surface of the organic photoreceptor drum is primarily composed of a resin component. Therefore, the surface of the organic photoreceptor drum has a tendency to progress deterioration caused by a chemical effect of ozone produced by a corona discharge of the charging device. However, the deteriorated surface is abraded by receiving an abrading effect by the cleaning unit 15, and gradually but certainly removed. Therefore, a problem of deterioration of the surface caused by ozone or the like is actually solved, allowing stable maintenance of charge potential by charging operation over a long period.

According to the toner image forming section 2, the surfaces of the photoreceptor drums 11 in an evenly charged state by the charging sections 12 are irradiated from the exposure unit 13 with light in accordance with signals corresponding to image information to form electrostatic latent images, and toners are supplied from the developing sections 14 onto the electrostatic latent images to form toner images, and the toner images are transferred onto the intermediate transfer belt 25, and then the residual toners remaining on the surfaces of the photoreceptor drums 11 are removed by the cleaning units 15. This series of toner image forming operations are repeatedly implemented.

The transfer section 3 is arranged above the photoreceptor drums 11, and includes the intermediate transfer belt 25, a driving roller 26, a driven roller 27, intermediate transfer rollers 28(*b, c, m, y*), a transfer belt cleaning unit 29, and a transfer roller 30. The intermediate transfer belt 25 is an endless belt-shaped member which is suspended in a tensioned state by the driving roller 26 and the driven roller 27, and thus is formed in a looped shape, and the intermediate transfer belt 25 rotates in a direction of an arrow B. When the intermediate transfer belt 25 travels while contacting the photoreceptor drums 11, a transfer bias having an opposite polarity from a charge polarity of the toners on the surfaces of the photoreceptor drums 11 is applied from the intermediate transfer rollers 28 which are arranged opposite to the photoreceptor drums 11 via the intermediate transfer belt 25, and the toner images formed on the surfaces of the photoreceptor drums 11 are transferred onto the intermediate transfer belt 25. In a case of a full-color image, the toner images having respective colors which are formed on the respective photoreceptor drums 11 are sequentially overlaid and transferred onto the intermediate transfer belt 25 to form a full-color toner image. The driving roller 26 is arranged to rotate around an axis thereof by a driving mechanism (not shown), and rotates the intermediate transfer belt 25 in a direction of the arrow B by the rotational drive of the driving roller 26. The driven roller 27 is arranged so as to rotate by the rotational drive of the driving roller 26, and applies a certain level of stress to the intermediate transfer belt 25 so as not to loosen the intermediate transfer belt 25. The intermediate transfer roller 28 is in pressure contact with the photoreceptor drums 11 via the intermediate transfer belt 25, and arranged to rotate around an axis thereof by the driving mechanism (not shown). The intermediate transfer rollers 28 have a power supply (not shown) which applies the transfer bias as described above connected, and have a function that allows the toner images on the surfaces of the photoreceptor drums 11 to be transferred onto the intermediate transfer belt 25. The transfer belt cleaning unit 29 is opposite to the driven roller 27 via the intermediate transfer belt 25, and arranged in contact with an outer peripheral surface of the intermediate transfer belt 25.

The toners which are attached to the intermediate transfer belt 25 by contact with the photoreceptor drums 11 causes contamination of a back surface of the recording medium. Therefore, the transfer belt cleaning unit 29 removes the toners on the surface of the intermediate transfer belt 25, and collects them. The transfer roller 30 is in pressure contact with the driving roller 26 via the intermediate transfer belt 25, and arranged to rotate around an axis thereof by the driving mechanism (not shown). In a pressure contact area (a transfer nip area) between the transfer roller 30 and the driving roller 26, the toner images which are borne and transported by the intermediate transfer belt 25, are transferred onto the recording medium which is fed from the recording medium feeding section 5 as described later. The recording medium bearing the toner image is fed to the fixing section 4. According to the transfer section 3, the toner images which are transferred from the photoreceptor drums 11 to the intermediate transfer belt 25 in pressure contact areas between the photoreceptor drums 11 and the intermediate transfer rollers 28 are transported to the transfer nip area by a rotational drive of the intermediate transfer belt 25 in a direction of the arrow B, and transferred onto the recording medium therein.

The fixing section 4 is arranged on a more downstream side than the transfer section 3 in a transporting direction of the recording medium, and includes a heating roller 31 and a pressure roller 32, and further includes a heating source of the heating roller 31, a sensor for detecting a temperature of the heating roller 31, and a control portion for controlling operation of the heating source so as to maintain a predetermined temperature of the heating roller 31. The heating roller 31 and the pressure roller 32 are in pressure contact with each other, and arranged so as to rotate around axes thereof by the driving mechanism (not shown), and transport the recording medium in a pressure contact area (a fixing nip area) thereof in a nipped and pressured manner. The fixing section 4 heats and pressurizes the toner image to fix it to the recording medium, and forms a firm recording image, when the recording medium bearing the toner image fed from the transfer section 3 passes through the fixing nip area. According to the fixing section 4, the recording medium bearing the toner image is heated and pressurized when passing through the pressure contact area, and the toner image is thus fixed to the recording medium to form an image.

The recording medium feeding section 5 includes an automatic paper feeding tray 35, a pickup roller 36, transporting rollers 37, regist rollers 38, and a manual paper feeding tray 39. The automatic paper feeding tray 35 is arranged in a lower part of the image forming apparatus 1 in a vertical direction, and is a container-shaped member which stores the recording medium. Examples of the recording medium include a sheet of regular paper, a sheet of copier paper, an overhead projector sheet, and a postcard. The pickup roller 36 picks up the recording media stored in the automatic paper feeding tray 35 sheet by sheet to feed it to a paper transporting path S1. The transporting rollers 37 are a pair of roller members which are arranged in pressure contact with each other, and transport the recording medium toward the regist rollers 38. The regist rollers 38 are a pair of roller members which are arranged in pressure contact with each other, and feed the recording medium fed from the transporting rollers 37 to the transfer nip area, while the toner borne by the intermediate transfer belt 25 is transported to the transfer nip area. The manual paper feeding tray 39 is a device for taking the recording manual into the image forming apparatus 1 by manual operation, and the recording medium taken in from the manual paper feeding tray 39 is passed through a paper transporting path S2 by the transporting rollers 37, and fed to the regist rollers 38. According to the recording medium feeding section 5, the recording medium supplied sheet by sheet from the automatic paper feeding tray 35 or the manual paper feeding tray 39 is fed to the transfer nip area, while the toner borne by the intermediate transfer belt 25 is transported to the transfer nip area.

The discharging section 6 includes the transporting rollers 37, discharging rollers 40, and a discharging tray 41. The transporting rollers 37 are arranged in a more downstream side than the fixing nip area in a paper transporting direction, and transport the recording medium having an image fixed by the fixing section 4 toward the discharging roller 40. The discharging rollers 40 discharge the recording medium having an image fixed to the discharging tray 41 which is arranged on an upper surface of the image forming apparatus 1 in a vertical direction. The discharging tray 41 stores the recording medium having an image fixed.

The image forming apparatus 1 is provided with a control unit 50. The control unit 50 is arranged, for example, in an upper portion of an internal space of the image forming apparatus 1, and includes a processing circuit realized by a microcomputer or the like having a central processing unit (CPU) which includes a control portion, a calculation portion, and a storage portion. To the storage portion of the control unit 50, there are inputted image forming instructions via an operation panel (not shown) arranged on an upper surface of the image forming apparatus 1, detected results sent from a sensor (not shown) and the like arranged at various positions inside the image forming apparatus 1, image information sent from an external apparatus, and the like. In the calculation portion of the control unit 50, based on the inputted various data (the image forming instructions, detected results, and the image information), determination is carried out. According to the determination result of the calculation portion, a control signal is sent from the control portion of the control unit 50. Accordingly, total operation of the image forming apparatus 1 is controlled. As the storage portion, memory devices commonly used in this field may be used, and include a read only memory (ROM), a random access memory (RAM), and a hard disk drive (HDD), for example. As the external apparatus, electrical and electronic apparatuses capable of forming or obtaining the image information, and of electrically connecting the image forming apparatus 1 may be used, and examples thereof include computers, digital cameras, TV sets, video recorders, and DVD recorders, and facsimiles. The control unit 50 includes a power supply together with the above-described processing circuit, and the power supply supplies power not only to the control unit 50, but to the respective devices inside the image forming apparatus 1.

According to the image forming apparatus 1, the toner images formed in the toner image forming section 2 are transferred onto the intermediate transfer belt 25 of the transfer section 3, and the toner images on the intermediate transfer belt 25 are transferred onto the recording medium by the fixing section 4 to form the image, and the recording medium on which the image has been formed is discharged to the discharging tray 41 via the discharging section 6.

EXAMPLES

Hereinafter, referring to comparative manufacturing examples, examples and comparative examples, are specifically described. In the following description, unless otherwise noted, "%" and "parts" represent "% by weight" and "parts by weight" respectively.

Manufacturing Example 1

Manufacturing of Black Toner

A master batch kneaded material was prepared by mixing 70 parts of a polyester resin A (a binder resin, a carnauba wax internal additive 10%, manufactured by Kao Corp.), and 30 parts of carbon black (a colorant, trade name: NiPex-60, manufactured by Degussa Japan Co., Ltd.) and then melt-kneading the mixture. Thereafter, black toner particles having a volume average particle diameter of 6.5 μm and a colorant content of 7.3% were obtained by mixing 60 parts of the polyester resin A, 20 parts of the master batch kneaded material, and 1 part of a charge control agent (trade name: LR-147, manufactured by Japan Carlit Co., Ltd), and then melt-kneading the mixture at a cylinder temperature of 90° C. and barrel revolutions of 180 rpm using a two-axis extruder (trade name: PCM-30, manufactured by Ikegai Corp.), and pulverizing and classifying a solidified material of the resultant melt-kneaded material. The black toner particles had a shape factor SF-1 of 145, a shape factor SF-2 of 150, and a time constant of 652 msec. Note that the volume average particle diameter of the toner particles was measured by using Coulter Multisizer II (trade name: Backman Coulter, Inc.). A number of measured particles was 50,000 counts, and an aperture diameter was 100 μm. The black toner was manufactured by mixing 100 parts of the black toner particles obtained and 1 part of silica (a flow modifier, trade name: R976S, manufactured by Aerosil Co., Ltd.).

Manufacturing Example 2

Manufacturing of Cyan Toner

The same procedure as in Example 1 was followed except that blue pigment (C.I. Pigment Blue 15-3, manufactured by Sanyo Color Works, Ltd.) was used instead of carbon black. Accordingly, cyan toner particles having a volume average particle diameter of 6.5 μm and a colorant content of 7.3% were manufactured. The cyan toner particles had a shape factor SF-1 of 143, a shape factor SF-2 of 148, and a time constant of 710 msec. The cyan toner was manufactured by mixing 100 parts of the cyan toner particles obtained and 1 part of silica (R976S).

Manufacturing Example 3

Manufacturing of Magenta Toner

The same procedure as in Example 1 was followed except that red pigment (C.I. Pigment Red 57-1, manufactured by Sanyo Color Works, Ltd.) was used instead of carbon black. Accordingly, magenta toner particles having a volume average particle diameter of 6.5 μm and a colorant content of 7.3% were manufactured. The magenta toner particles had a shape factor SF-1 of 140, a shape factor SF-2 of 145, and a time constant of 880 msec. The magenta toner was manufactured by mixing 100 parts of the magenta toner particles obtained and 1 part of silica (R976S).

Manufacturing Example 4

Manufacturing of Yellow Toner

The same procedure as in Example 1 was followed except that yellow pigment (C.I. Pigment Yellow 74, manufactured by Sanyo Color Works, Ltd.) was used instead of carbon black. Accordingly, yellow toner particles having a volume average particle diameter of 6.5 μm and a colorant content of 7.3% were manufactured. The yellow toner particles had a shape factor SF-1 of 138, a shape factor SF-2 of 140, and a time constant of 1090 msec. The yellow toner was manufactured by mixing 100 parts of the yellow toner particles obtained and 1 part of silica (R976S).

Manufacturing Example 5

Manufacturing of Black Toner

The same procedure as in Example 1 was followed except that a mixing amount of carbon black was changed. Accordingly, black toner particles having a volume average particle diameter of 6.2 μm and a colorant content of 5.4% were manufactured. The black toner particles had a shape factor SF-1 of 155, a shape factor SF-2 of 158, and a time constant of 920 msec. The black toner was manufactured by mixing 100 parts of the black toner particles obtained and 1 part of silica (R976S).

Manufacturing Example 6

Manufacturing of Cyan Toner

The same procedure as in Example 2 was followed except that a mixing amount of the blue pigment was changed. Accordingly, cyan toner particles having a volume average particle diameter of 6.2 μm and a colorant content of 5.4% were manufactured. The cyan toner particles had a shape factor SF-1 of 148, a shape factor SF-2 of 156, and a time constant of 1090 msec. The cyan toner was manufactured by mixing 100 parts of the cyan toner particles obtained and 1 part of silica (R976S).

Manufacturing Example 7

Manufacturing of Magenta Toner

The same procedure as in Example 3 was followed except that a mixing amount of the red pigment was changed. Accordingly, magenta toner particles having a volume average particle diameter of 6.2 μm and a colorant content of 5.4% were manufactured. The magenta toner particles had a shape factor SF-1 of 160, a shape factor SF-2 of 158, and a time constant of 1350 msec. The magenta toner was manufactured by mixing 100 parts of the magenta toner particles obtained and 1 part of silica (R976S).

Manufacturing Example 8

Manufacturing of Yellow Toner

The same procedure as in Example 4 was followed except that a mixing amount of the yellow pigment was changed. Accordingly, yellow toner particles having a volume average particle diameter of 6.2 μm and a colorant content of 5.4% were manufactured. The yellow toner particles had a shape factor SF-1 of 152, a shape factor SF-2 of 155, and a time constant of 1530 msec. The yellow toner was manufactured by mixing 100 parts of the yellow toner particles obtained and 1 part of silica (R976S).

Manufacturing Example 9

Manufacturing of Comparative Black Toner

The same procedure as in Example 1 was followed except that a mixing amount of carbon black was changed. Accordingly, black toner particles having a volume average particle diameter of 6.8 μm and a colorant content of 12.2% were manufactured. The black toner particles had a shape factor SF-1 of 165, a shape factor SF-2 of 170, and a time constant of 260 msec. The black toner was manufactured by mixing 100 parts of the black toner particles obtained and 1 part of silica (R976S).

Manufacturing Example 10

Manufacturing of Comparative Cyan Toner

The same procedure as in Example 2 was followed except that a mixing amount of the blue pigment was changed. Accordingly, cyan toner particles having a volume average particle diameter of 6.8 μm and a colorant content of 17.0% were manufactured. The cyan toner particles had a shape factor SF-1 of 168, a shape factor SF-2 of 165, and a time constant of 280 msec. The cyan toner was manufactured by mixing 100 parts of the cyan toner particles obtained and 1 part of silica (R976S).

Manufacturing Example 11

Manufacturing of Comparative Magenta Toner

The same procedure as in Example 3 was followed except that a mixing amount of the red pigment was changed. Accordingly, magenta toner particles having a volume average particle diameter of 6.8 μm and a colorant content of 17.0% were manufactured. The magenta toner particles had a shape factor SF-1 of 165, a shape factor SF-2 of 168, and a time constant of 370 msec. The magenta toner was manufactured by mixing 100 parts of the magenta toner particles obtained and 1 part of silica (R976S).

Manufacturing Example 12

Manufacturing of Comparative Yellow Toner

The same procedure as in Example 4 was followed except that a mixing amount of the yellow pigment was changed. Accordingly, yellow toner particles having a volume average particle diameter of 6.8 μm and a colorant content of 17.0% were manufactured. The yellow toner particles had a shape factor SF-1 of 170, a shape factor SF-2 of 170, and a time constant of 560 msec. The yellow toner was manufactured by mixing 100 parts of the yellow toner particles obtained and 1 part of silica (R976S).

Manufacturing Example 13

Manufacturing of Black Toner

Droplets of a monomer mixture were granulated by finely dispersing 80.5 parts of styrene, 19.5 parts of n-butylacrylate, 0.3 part of polymethacrylic acid ester macromonomer, 0.5 part of divinylbenzene, 1.2 parts of t-dodecylmercaptan, 7 parts of carbon black (NiPex-60), 1 part of a charge control agent (LR-147), and 2 parts of a release agent (a Fischer-Tropsch wax, trade name: Paraflint Spray 30, manufactured by Sasol Ltd.), agitating the dispersion until the droplets become stable using an ultrasonic emulsifying machine, adding 6 parts of t-butylperoxy-2-ethylhexanoate (a polymerization starter, trade name: Perbutyl O, manufactured by NOF Corp.) to the agitated dispersion, and then agitating the resultant dispersion at a high-shear rate using a granulating machine (trade name: Ebara Milder, manufactured by Ebara Corp.). A water dispersion of colored polymer particles was obtained by putting a water dispersion of the droplets of the monomer mixture obtained into a reactor having an agitating blade attached to start a polymerization reaction at a temperature of 85° C., and adding 0.3 part of a water-soluble starter (2,2'-azobis(2-methyl-N-(2-hydroxyethyl)-propionamide, trade name: VA-086, manufactured by Wako Pure Chemical Industries, Ltd) to the reactor after a polymerization conversion ratio reached substantially 100%, and continuing the polymerization for 4 hours, and then cooling the reactor to stop the reaction. At this time, solid content density of the water dispersion of the colored polymer particles was 27% by weight. Magnesium hydroxide of the surfaces of the colored polymer particles was rendered soluble in water by adding sulfuric acid to the dispersion of the colored polymer particles until it reached pH4. The dispersion in which magnesium hydroxide was rendered soluble in water was supplied to a continuous belt filter (trade name: Eagle filter, manufactured by Sumitomo Heavy Industries, Ltd.), and the resultant solid content was subjected to cleaning and deliquoring in 10 times its volume of ion-exchange water. A moisture content of a moist colored polymer particle cake obtained was 35%.

The dispersion of the colored polymer particles having solid content density of 20% was prepared by adding ion-exchange water to the moist colored polymer particle cake to disperse once again the colored polymer particles. Then, a five-layer laminated porous metal body (filtration accuracy: 2 μm, made of stainless steel, trade name: Fuji plate, manufactured by Fuji Filter Mfg. Co., Ltd.) which was produced by vacuum sintering as a filtering media, was fixed to a basket type centrifugal filtration machine (trade name: KM-20 type, manufactured by Matsumoto Kikai Mfg Co., Ltd.). While operating the filtration machine at a centrifugal effect of 500 G, 600 parts of the dispersion were supplied to the filtration machine spending around 3 minutes. After the dispersion of the colored polymer particles was totally supplied, the basket type centrifugal filtration machine was accelerated to a level of a centrifugal effect of 1200 G, and deliquoring was conducted for 4 minutes. After the deliquoring, filter cake in the basket type centrifugal filtration machine was scraped to leave a cake thickness of 5 mm by a filter cake scraping apparatus. The remaining cake having a thickness of 5 mm was totally collected by an air blow. At this time, solid content density of filtrate was 0 ppm, and a moisture content of the filter cake was 12.9%. This procedure was repeated 20 times, but a filtration rate was not decreased. Black toner particles having a volume average particle diameter of 5.0 μm and a colorant content of 8.5% were obtained by drying the filter cake obtained at a temperature of 50° C. for 8 hours using a vacuum dryer. The black toner was manufactured by mixing 100 parts of the black toner particles obtained and 1 part of Silica (R976S).

Manufacturing Example 14

Manufacturing of Cyan Toner

The same procedure as in Example 13 was followed except that blue pigment (C.I. Pigment Blue 15-3) was used instead of carbon black. Accordingly, cyan toner particles having a volume average particle diameter of 5.0 μm and a colorant content of 8.5% were manufactured. The cyan toner particles had a shape factor SF-1 of 116, a shape factor SF-2 of 120, and a time constant of 520 msec. The cyan toner was manufactured by mixing 100 parts of the cyan toner particles obtained and 1 part of silica (R976S).

Manufacturing Example 15

Manufacturing of Magenta Toner

The same procedure as in Example 1 was followed except that red pigment (C.I. Pigment Red 57-1) was used instead of carbon black. Accordingly, magenta toner particles having a volume average particle diameter of 5.0 μm and a colorant content of 8.5% were manufactured. The magenta toner particles had a shape factor SF-1 of 112, a shape factor SF-2 of 110, and a time constant of 620 msec. The magenta toner was manufactured by mixing 100 parts of the magenta toner particles obtained and 1 part of silica (R976S).

Manufacturing Example 16

Manufacturing of Yellow Toner

The same procedure as in Example 1 was followed except that yellow pigment (C.I. Pigment Red 74) was used instead of carbon black. Accordingly, yellow toner particles having a volume average particle diameter of 5.0 μm and a colorant content of 8.5% were manufactured. The yellow toner particles had a shape factor SF-1 of 105, a shape factor SF-2 of 109, and a time constant of 700 msec. The yellow toner was manufactured by mixing 100 parts of the yellow toner particles obtained and 1 part of silica (R976S).

Manufacturing Example 17

Manufacturing of Black Toner

The same procedure as in Example 13 was followed except that a mixing amount of carbon black was changed. Accordingly, black toner particles having a volume average particle diameter of 4.6 μm and a colorant content of 5.3% were manufactured. The black toner particles had a shape factor SF-1 of 128, a shape factor SF-2 of 130, and a time constant of 650 msec. The black toner was manufactured by mixing 100 parts of the black toner particles obtained and 1 part of silica (R976S).

Manufacturing Example 18

Manufacturing of Cyan Toner

The same procedure as in Example 14 was followed except that a mixing amount of the blue pigment was changed. Accordingly, cyan toner particles having a volume average particle diameter of 4.6 μm and a colorant content of 5.3% were manufactured. The cyan toner particles had a shape factor SF-1 of 126, a shape factor SF-2 of 128, and a time constant of 720 msec. The cyan toner was manufactured by mixing 100 parts of the black toner particles obtained and 1 part of silica (R976S).

Manufacturing Example 19

Manufacturing of Magenta Toner

The same procedure as in Example 15 was followed except that a mixing amount of the red pigment was changed. Accordingly, magenta toner particles having a volume average particle diameter of 4.6 μm and a colorant content of 5.3% were manufactured. The magenta toner particles had a shape factor SF-1 of 122, a shape factor SF-2 of 120, and a time constant of 880 msec. The magenta toner was manufactured by mixing 100 parts of the magenta toner particles obtained and 1 part of silica (R976S).

Manufacturing Example 20

Manufacturing of Yellow Toner

The same procedure as in Example 16 was followed except that a mixing amount of the yellow pigment was changed. Accordingly, yellow toner particles having a volume average particle diameter of 4.6 μm and a colorant content of 5.3% were manufactured. The yellow toner particles had a shape factor SF-1 of 118, a shape factor SF-2 of 120, and a time constant of 1090 msec. The yellow toner was manufactured by mixing 100 parts of the yellow toner particles obtained and 1 part of silica (R976S).

Manufacturing Example 21

Manufacturing of Comparative Black Toner

The same procedure as in Example 13 was followed except that a mixing amount of carbon black was changed. Accordingly, black toner particles having a volume average particle diameter of 5.0 μm and a colorant content of 4.5% were manufactured. The black toner particles had a shape factor SF-1 of 108, a shape factor SF-2 of 110, and a time constant of 990 msec. The black toner was manufactured by mixing 100 parts of the black toner particles obtained and 1 part of silica (R976S).

Manufacturing Example 22

Manufacturing of Comparative Cyan Toner

The same procedure as in Example 14 was followed except that a mixing amount of the blue pigment was changed. Accordingly, cyan toner particles having a volume average particle diameter of 5.0 μm and a colorant content of 4.5% were manufactured. The cyan toner particles had a shape factor SF-1 of 110, a shape factor SF-2 of 105, and a time constant of 1200 msec. The cyan toner was manufactured by mixing 100 parts of the cyan toner particles obtained and 1 part of silica (R976S).

Manufacturing Example 23

Manufacturing of Comparative Magenta Toner

The same procedure as in Example 15 was followed except that a mixing amount of the red pigment was changed. Accordingly, cyan toner particles having a volume average particle diameter of 5.0 μm and a colorant content of 4.5% were manufactured. The magenta toner particles had a shape factor SF-1 of 102, a shape factor SF-2 of 105, and a time constant of 1480 msec. The magenta toner was manufactured by mixing 100 parts of the magenta toner particles obtained and 1 part of silica (R976S).

Manufacturing Example 24

Manufacturing of Comparative Yellow Toner

The same procedure as in Example 16 was followed except that a mixing amount of the yellow pigment was changed. Accordingly, yellow toner particles having a volume average particle diameter of 5.0 μm and a colorant content of 4.5% were manufactured. The yellow toner particles had a shape factor SF-1 of 106, a shape factor SF-2 of 105, and a time constant of 1680 msec. The yellow toner was manufactured by mixing 100 parts of the yellow toner particles obtained and 1 part of silica (R976S).

Examples 1 to 4 and Comparative Examples 1 to 2

1000 g of a two-component developer was prepared by agitating and mixing 70 g of the toner obtained in the manufacturing examples 1 to 24, and 930 g of a magnetic carrier (a volume average diameter: 50 μm, a silicone resin coated carrier, manufactured by Powder-Tech Co., Ltd.) for 30 minutes using a V-type blending machine. An actual copying test was conducted using 30,000 sheets of paper (Nekosa latter paper) having a letter size and a testing character area rate of 5%, by filling the two-component developers obtained into four developer tanks of a commercially available digital color copying machine (trade name: MX-4500, manufactured by Sharp Corp.), according to a combination shown in Table 1 (Note that Table 1 shows only a toner), so as to achieve an order of yellow, magenta, cyan, and black from an upstream side in a rotational direction of the intermediate transfer belt with respect to the four tanks. Note that the copying machine was set such that an attaching amount of the respective single color toners to the photoreceptor drums were 0.3 mg/cm$^2$ to 0.4 mg/cm$^2$ during the actual copying test. The following tests (a) to (d) were conducted with respect to each actual copying of 3,000 sheets during the actual copying test. The results are shown in Table 1.

(a) Contamination of Intermediate Transfer Belt

Based on a visual check for contamination of the intermediate transfer belt, the developer which caused no contamination of the intermediate transfer belt through the actual copying of 30,000 sheets was determined as "OK", and the developer which caused contamination thereof through the actual copying of 30,000 sheets was determined as "NG".

(b) Transfer Efficiency

The developer which provided a transfer efficiency of 95% or more through the actual copying of 30,000 sheets was determined as "OK", and the developer which once provided a transfer efficiency of less than 95% through the actual copying of 30,000 sheets was determined as "NG". The transfer efficiency was evaluated according to the following procedure. The post-transfer residual toner on the photoreceptor after a solid image was transferred was removed by taping it with a mylar tape, and then Macbeth density was measured by sticking the maylar tape on a sheet of white paper which is not in use, and taken as a measurement value "C". Macbeth density was measured by sticking the maylar tape bearing the unfixed toner image after a solid image was transferred on a sheet of white paper which is not in use, and taken as a measurement value "E". Further, Macbeth density was measured by sticking the maylar tape on a sheet of white paper which is not in use, and taken as a measurement value "D". At this time, the transfer efficiency was expressed as follows: Transfer Efficiency (%)=[(E−C)/(E−D)]×100.

(c) Fogging Level

Based on a visual check for the surfaces of the photoreceptor drums, the developer which caused no fogging on the surfaces of the photoreceptor drums through the actual copying of 30,000 sheets was determined as "OK", and the developer which once caused fogging thereon through the actual copying of 30,000 sheets was determined as "NG".

(d) Comprehensive Judgment

With respect to the three evaluation items as described above, the developer which provided "OK" for all judgments was determined as a comprehensive judgment "OK", and the developer which provided "NG" for any of three judgments was determined as a comprehensive judgment "NG".

TABLE 1

| | Toner particles | | | | | | Judgment | | | |
|---|---|---|---|---|---|---|---|---|---|---|
| | Manufacturing example number | Color | Time constant msec | SF-1 | SF-2 | Volume average diameter μm | a | b | c | d |
| Example 1 | 1 | Black | 652 | 145 | 150 | 6.5 | OK | OK | OK | OK |
| | 2 | Cyan | 710 | 143 | 148 | " | OK | OK | OK | OK |
| | 3 | Magenta | 880 | 140 | 145 | " | OK | OK | OK | OK |
| | 4 | Yellow | 1090 | 138 | 140 | " | OK | OK | OK | OK |
| Example 2 | 13 | Black | 410 | 110 | 115 | 5.0 | OK | OK | OK | OK |
| | 14 | Cyan | 520 | 116 | 120 | " | OK | OK | OK | OK |
| | 15 | Magenta | 620 | 112 | 110 | " | OK | OK | OK | OK |
| | 16 | Yellow | 700 | 105 | 109 | " | OK | OK | OK | OK |
| Example 3 | 5 | Black | 920 | 155 | 158 | 6.2 | OK | OK | OK | OK |
| | 6 | Cyan | 1090 | 148 | 156 | " | OK | OK | OK | OK |
| | 7 | Magenta | 1350 | 160 | 158 | " | OK | OK | OK | OK |
| | 8 | Yellow | 1530 | 152 | 155 | " | OK | OK | OK | OK |
| Example 4 | 17 | Black | 650 | 128 | 130 | 4.6 | OK | OK | OK | OK |
| | 18 | Cyan | 720 | 126 | 128 | " | OK | OK | OK | OK |
| | 19 | Magenta | 880 | 122 | 120 | " | OK | OK | OK | OK |
| | 20 | Yellow | 1090 | 118 | 120 | " | OK | OK | OK | OK |

TABLE 1-continued

| | Toner particles | | | | | | Judgment | | | |
|---|---|---|---|---|---|---|---|---|---|---|
| | Manufacturing example number | Color | Time constant msec | SF-1 | SF-2 | Volume average diameter μm | a | b | c | d |
| Comp. Example 1 | 9 | Black | 260 | 165 | 170 | 6.8 | NG | NG | NG | NG |
| | 10 | Cyan | 280 | 168 | 165 | " | NG | NG | NG | NG |
| | 11 | Magenta | 370 | 165 | 168 | " | NG | NG | NG | NG |
| | 12 | Yellow | 560 | 170 | 170 | " | NG | NG | NG | NG |
| Comp. Example 2 | 21 | Black | 990 | 108 | 110 | 5.0 | OK | NG | OK | NG |
| | 22 | Cyan | 1200 | 110 | 105 | " | OK | NG | OK | NG |
| | 23 | Magenta | 1480 | 102 | 105 | " | OK | NG | OK | NG |
| | 24 | Yellow | 1680 | 106 | 105 | " | OK | NG | OK | NG |

As apparent from Table 1, the high-speed image forming apparatus having no contamination of the intermediate transfer belt, no fogging, and the high transfer efficiency are realized by adjusting the time constants of the respective toners into a predetermined range, in addition to only decreasing the time constants τ in an order of black, cyan, magenta, and yellow.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and a range of equivalency of the claims are therefore intended to be embraced therein.

What is claimed is:

1. A color image forming method, comprising:

a plurality of image forming steps of forming toner images using a two-component developer containing a toner, and a carrier containing a carrier having a coating layer containing polyolefin on an entire surface or a part of the surface thereof, wherein a yellow toner image, a magenta toner image, a cyan toner image and a black toner image using a yellow toner, a magenta toner, a cyan toner and a black toner which are four toners of different colors, are formed individually, wherein with respect to a shape factor SF-1 of each of color toners, the yellow toner is in a range of 105 or more and 152 or less, the magenta toner is in a range of 112 or more and 160 or less, the cyan toner is in a range of 116 or more and 148 or less and the black toner is in a range of 110 or more and 155 or less, wherein with respect to a shape factor SF-2 of each of color toners, the yellow toner is in a range of 109 or more and 155 or less, the magenta toner is in a range of 110 or more and 158 or less, the cyan toner is in a range of 120 or more and 156 or less and the black toner is in a range of 115 or more and 158 or less, and wherein a volume average particle diameter of each of color toners is selected from a range of from 4.6 μm to 6.5 μm;

an intermediate transfer step of sequentially overlaying one by one the plurality of toner images of different colors formed at the respective image forming steps on an intermediate transfer medium in an order of the yellow toner image, the magenta toner image, the cyan toner image and the black toner image to form a multicolor toner image as a laminated body of the toner images of different colors;

a secondary transfer step of transferring the multicolor toner image formed on the intermediate transfer medium at the intermediate transfer step, onto a recording medium; and a fixing step of fixing the multicolor toner image transferred onto the recording medium at the secondary transfer step, wherein with respect to a time constant of each of color toners used at each image forming step, the yellow toner is selected from a range of from 600 msec to 1600 msec, the magenta toner is selected from a range of from 450 msec to 1400 msec, the cyan toner is selected from a range of from 400 msec to 1150 msec and the black toner is selected from a range of from 350 msec to 950 msec, and the time constants thereof are increased in an order of the black toner, the cyan toner, the magenta toner and the yellow toner.

2. The color image forming method of claim 1, wherein each of the image forming steps includes:

a charging step of charging a photosensitive layer on a surface of a photoreceptor;

an exposure step of exposing the surface of the photoreceptor to light in accordance with signals corresponding to image information to form an electrostatic latent image; and a developing step of developing the electrostatic latent image to form the toner image by using a developer containing the toner.

3. A color image forming apparatus, comprising:

a plurality of image forming sections for forming toner images using a two-component developer containing a toner and a carrier containing a carrier having a coating layer containing polyolefin on an entire surface or a part of the surface thereof, the plurality of image forming sections forming a yellow toner image, a magenta toner image, a cyan toner image and a black toner image using a yellow toner, a magenta toner, a cyan toner and a black toner which are four toners of different colors, individually;

an intermediate transfer section for sequentially overlaying one by one the toner images of different colors which are formed in the respective image forming sections on an intermediate transfer medium in an order of the yellow toner image, the magenta toner image, the cyan toner image and the black toner image to form a multicolor toner image as a laminated body of the toner images of different colors thereon;

a secondary transfer section for transferring the multicolor toner image formed on the intermediate transfer medium by the intermediate transfer section, onto a recording medium; and a fixing section for fixing the multicolor toner image transferred onto the recording medium by the secondary transfer section, wherein with respect to a shape factor SF-1 of each of color toners, the yellow toner is in a range of 105 or more and 152 or less, the magenta toner is in a range of 112 or more and 160 or less, the cyan toner is in a range of 116 or more and 148 or less and the black toner is in a range of 110 or more and 1.55 or less, wherein with respect to a shape factor SF-2, the yellow toner is in a range of 109 or more and 155 or less, the magenta toner is in a range of 110 or more and 1.58 or less, the cyan toner is in a range of 120 or more and 156 or less and the black toner is in a range of 115 or more and 158 or less, wherein a volume average particle diameter of each of color toners is selected from a range of from 4.6 μm to 6.5 μm, and wherein with respect to a time constant of each of color toners used in each image forming section, the yellow toner is selected from a range of from 600 msec to 1600 msec, the magenta toner is selected from a range of from 450 msec to 1400 msec, the cyan toner is selected from a range of 400 msec to 1150 msec and the black toner is selected from a range of from 350 msec to 950 msec, and the time constants thereof are increased in an order of the black toner, the cyan toner, the magenta toner and the yellow toner.

* * * * *